US008441190B2

(12) United States Patent
Shido

(10) Patent No.: US 8,441,190 B2
(45) Date of Patent: May 14, 2013

(54) VEHICULAR DISCHARGE LAMP

(75) Inventor: Masaya Shido, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 13/085,862

(22) Filed: Apr. 13, 2011

(65) Prior Publication Data

US 2011/0254439 A1 Oct. 20, 2011

(30) Foreign Application Priority Data

Apr. 15, 2010 (JP) ..... 2010-094085

(51) Int. Cl.
*H01J 17/16* (2012.01)

(52) U.S. Cl.
USPC ..... 313/635; 313/632

(58) Field of Classification Search ..... 313/632, 313/633, 635
See application file for complete search history.

(56) References Cited

U.S. PATENT DOCUMENTS

| | | | | |
|---|---|---|---|---|
| 4,823,050 | A * | 4/1989 | English et al. | 313/634 |
| 4,970,431 | A * | 11/1990 | Vegter et al. | 313/634 |
| 6,404,129 | B1 * | 6/2002 | Hendricx et al. | 313/620 |
| 2002/0047610 | A1 * | 4/2002 | Arimoto et al. | 315/246 |
| 2010/0244689 | A1 * | 9/2010 | Kagebayashi et al. | 313/632 |
| 2011/0260613 | A1 * | 10/2011 | Deguchi et al. | 313/637 |

FOREIGN PATENT DOCUMENTS

| | | | |
|---|---|---|---|
| JP | 2007-250225 | A | 9/2007 |
| WO | WO 2009/025119 | A1 * | 2/2009 |

* cited by examiner

*Primary Examiner* — Anh Mai
*Assistant Examiner* — Andrew Coughlin
(74) *Attorney, Agent, or Firm* — Sughrue Mion, PLLC

(57) ABSTRACT

A vehicular discharge lamp that emits light by a DC lighting system, the vehicular discharge lamp includes: an outer tube; a light emitting tube disposed in the outer tube and including a light emitting portion and fine tube portions connected to the light emitting portion; cathode-side and anode-side electrodes disposed in the light emitting tube; two lead wires connected to the electrodes; and a metal film or a metal oxide applied on an outer peripheral surface of the fine tube portion on an anode side of the light emitting tube, or the metal wire being wound on the outer peripheral surface. Inert gas having negative pressure is filled in a space outside the light emitting tube in the outer tube, and a negative high-voltage pulse is applied to the anode-side electrode at a time of start-up.

10 Claims, 3 Drawing Sheets

VEHICULAR DISCHARGE LAMP

CROSS REFERENCE TO RELATED APPLICATION(S)

The present disclosure relates to the subject matters contained in Japanese Patent Application No. 2010-094085 filed on Apr. 15, 2010, which are incorporated herein by reference in its entirety.

FIELD

One aspect of the present invention relates to a vehicular discharge lamp. More particularly, one aspect of the invention relates to a technical field where a size of a starting circuit or the like is reduced by reduction of a starting voltage that is achieved by applying a negative high-voltage pulse to an anode-side electrode at the time of a start-up of a vehicular discharge lamp.

BACKGROUND

Since a vehicle headlight requires the precise control of light distribution, unlike a general illumination lamp, the vehicle headlight needs to be uniformly formed to have a rod shape and the light emitting form needs to have a high contrast ratio. Since a filament of an incandescent lamp or a halogen lamp has these characteristics, a halogen lamp or an incandescent lamp is widely used as a light source for a vehicle headlight.

Meanwhile, the light intensity of a discharge lamp is higher than that of an incandescent lamp or a halogen lamp. Accordingly, in a vehicle headlight where a discharge lamp is used as a light source, it may be possible to improve the brightness and to obtain a longer life of a vehicle headlight using a discharge lamp is longer than that of a vehicle headlight using each of an incandescent lamp and a halogen lamp.

Since the brightness of a discharge lamp is higher than that of an incandescent lamp or a halogen lamp and the life of a discharge lamp is longer than that of an incandescent lamp or a halogen lamp as described above, use of a discharge lamp as a vehicle headlight has spread in recent years.

In general, a discharge lamp has a light emitting tube which holds a pair of electrodes and which holds a gas, such as inert gas, is sealed in an outer tube that protects the light emitting tube or stabilizes the temperature of the light emitting tube. The light emitting tube includes a light emitting portion in which discharge occurs and a pair of fine tube portions that are provided on the opposite sides of the light emitting portion. The light emitting portion is a portion where an arc is generated when discharge occurs, and the diameter of the light emitting portion is larger than that of the fine tube portion.

When a high-voltage pulse is applied to an electrode, discharge occurs in the light emitting portion of the light emitting tube, so that the discharge lamp starts to light up.

As examples of a lighting system of the discharge lamp, there are both AC lighting systems and DC lighting systems (see JP-A-2007-250225, for instance). In the discharge lamp using a DC lighting system, a pair of electrodes are referred to as a cathode-side electrode and an anode-side electrode, respectively.

Since the polarities of the electrodes are not switched in the discharge lamp using a DC lighting system, the discharge lamp using a DC lighting system has an advantage of reducing the loads of the electrodes as compared to a discharge lamp using an AC lighting system where a cathode-side electrode and an anode-side electrode can be exclusively designed for the loads of the electrodes, respectively.

Meanwhile, it can be important that a vehicular discharge lamp used as a light source for a vehicle light has reliable start-up (starting performance of 100%) and a quick rising characteristic after the start-up as compared to a general illumination discharge lamp. Accordingly, in the vehicular discharge lamp, in order to accelerate the rising characteristic, the power immediately after lighting (starting) is increased and the pressure of the inert gas to be sealed is increased.

Meanwhile, if the pressure of the inert gas is increased in order to accelerate the rising characteristic, the starting voltage is increased at the time of the start-up of the vehicular discharge lamp. For this reason, the reliability of the start-up may be impaired.

Further, the size of a starting circuit which applies a starting voltage to the discharge lamp may be increased in order to increase the starting voltage, leading to increased manufacturing costs.

SUMMARY

An object of exemplary embodiments of the present invention is to provide a vehicular discharge lamp that improves the reliability of the start-up of the vehicular discharge lamp and to reduce manufacturing costs of the vehicular discharge lamp by the reduction of the starting voltage.

With the above object in mind, there is provided a vehicular discharge lamp that lights up by a DC lighting system. The vehicular discharge lamp includes: an outer tube that is mounted on a socket; a light emitting tube that is disposed in the outer tube, and that includes a light emitting portion and a pair of fine tube portions connected to the light emitting portion on the opposite sides of the light emitting portion; a cathode-side electrode and an anode-side electrode that are disposed in the light emitting tube; two lead wires which are respectively connected to the cathode-side electrode and the anode-side electrode. Further at least a part of the cathode-side electrode and at least a part of the anode-side electrode are disposed in the outer tube. Inert gas having negative pressure is filled in a space that is formed outside the light emitting tube in the outer tube. A metal film or a metal oxide is applied, or a metal wire is wound, on the outer peripheral surface of the fine tube portion that is positioned on an anode side of the light emitting tube. A negative high-voltage pulse is applied to the anode-side electrode at a time of start-up.

Accordingly, a negative high-voltage pulse is applied to the anode-side electrode, so that the vehicular discharge lamp starts up.

A vehicular discharge lamp according to an exemplary embodiment of the present invention lights up by a DC lighting system. The vehicular discharge lamp includes: an outer tube that is mounted on a socket; a light emitting tube that is disposed in the outer tube, and that includes a light emitting portion and a pair of fine tube portions connected to the light emitting portion on the opposite sides of the light emitting portion; a cathode-side electrode and an anode-side electrode that are disposed in the light emitting tube; two lead wires which are respectively connected to the cathode-side electrode and the anode-side electrode. Further at least a part of the cathode-side electrode and at least a part of the anode-side electrode are disposed in the outer tube. Inert gas having negative pressure is filled in a space outside the light emitting tube in the outer tube. A metal film or a metal oxide is applied, or a metal wire is wound, on the outer peripheral surface of the fine tube portion that is positioned on the side of the light emitting tube corresponding to an anode. A negative high-voltage pulse is applied to the anode-side electrode at the time of the start-up.

Accordingly, it may be possible to reduce the starting voltage at the time of the start-up of the vehicular discharge lamp, and to improve the reliability of the start-up of the vehicular discharge lamp and to reduce manufacturing costs of the vehicular discharge lamp by the reduction of the starting voltage.

In another embodiment of the present invention, tungsten to which thorium oxide is added may be used as a material of the anode-side electrode.

Accordingly, losses caused by the discharge of electrons when a high-voltage pulse is applied to the anode-side electrode at the time of the start-up of the discharge lamp are reduced. Therefore, the temperature rise of the anode-side electrode is suppressed and the erosion of the anode-side electrode is suppressed. As a result, it may be possible to lengthen the life of the discharge lamp and to improve the luminous efficiency of the discharge lamp.

In another embodiment of the present invention, the maximum inner diameter of the light emitting portion may be set to 3 mm or less in a direction perpendicular to a direction where the pair of fine tube portions are connected to each other.

Accordingly, since gaps between the inner surface of the light emitting portion and the anode-side electrode and the cathode-side electrode are small, it may be possible to reduce the starting voltage.

BRIEF DESCRIPTION OF THE DRAWINGS

A general configuration that implements the various features of exemplary embodiments of the invention will be described with reference to the drawings. The drawings and the associated descriptions are provided to illustrate embodiments of the invention and should not limit the scope of the invention.

DETAILED DESCRIPTION OF THE EMBODIMENTS

A vehicular discharge lamp according to an exemplary embodiment of the invention will be described below with reference to the accompanying drawings. A vehicle headlight is provided with a vehicular discharge lamp.

The vehicle headlights 1 are disposed so as to be mounted on both the left and right end portions of a front end portion of a vehicle body.

Figure 1:
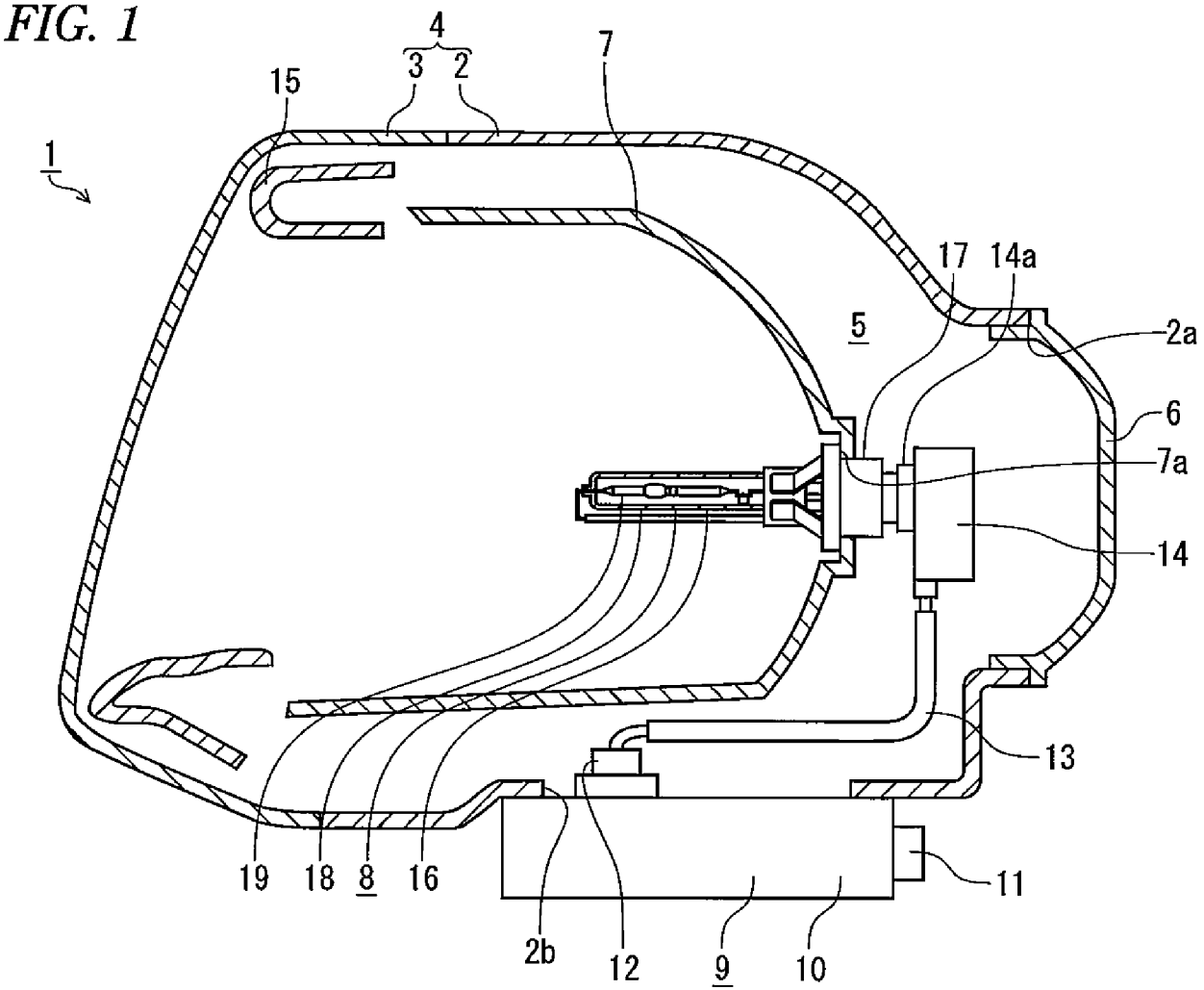
FIG. 1 is a view showing a vehicular discharge lamp according to an exemplary embodiment of the invention together with FIGS. 2 and 3, and is a schematic cross-sectional view of a vehicle headlight.

As shown in FIG. 1, the vehicle headlight 1 includes a lamp housing 2 that has a recess opened toward the front side and a cover 3 that closes the opening of the lamp housing 2, and a lamp outer case 4 is formed by the lamp housing 2 and the cover 3. An internal space of the lamp outer case 4 is formed as a lamp chamber 5.

An insertion hole 2*a*, which passes through the lamp housing 2 in a front-and-rear direction, is formed at a rear end portion of the lamp housing 2, and the insertion hole 2*a* is closed by a back cover 6. A positioning hole 2*b*, which passes through the lamp housing 2 in an up-and-down direction, is formed at a lower end portion of the lamp housing 2.

In the lamp chamber 5, a reflector 7 is supported by an optical axis adjustment mechanism (not shown) so as to be tiltable. Amounting hole 7*a*, which passes through the reflector in the front-and-rear direction, is formed at a rear end portion of the reflector 7.

A discharge lamp (vehicular discharge lamp) 8 is horizontally mounted on the mounting hole 7*a* of the reflector 7.

A discharge lamp lighting device 9 is mounted on the positioning hole 2*b* of the lamp housing 2. The discharge lamp lighting device 9 includes a lighting circuit (not shown) that is received in a case body 10. An input connector 11 is provided on the outer peripheral surface of the case body 10, and an output connector 12 is provided on the upper surface of the case body 10.

The input connector 11 is connected to a power supply circuit (not shown) by a connecting cord (not shown).

The output connector 12 is connected to a starting device 14 through a power supply cord 13, and a connector 14*a* of the starting device 14 is connected to a socket (to be described below) of the discharge lamp 8.

A power supply voltage of the power supply circuit is increased by a lighting circuit of the discharge lamp lighting device 9 and a high-voltage pulse is applied to the discharge lamp 8 through the power supply cord 13 and the starting device 14, so that discharge starts. As a result, the discharge lamp 8 lights (starts) up. A DC lighting system is used as a lighting system of the discharge lamp 8.

An extension 15, which shields a part of each component disposed in the lamp chamber 5, is provided in the lamp chamber 5. A shade (not shown), which blocks a part of the light emitted from the discharge lamp 8, is disposed in the lamp chamber 5.

Figure 2:
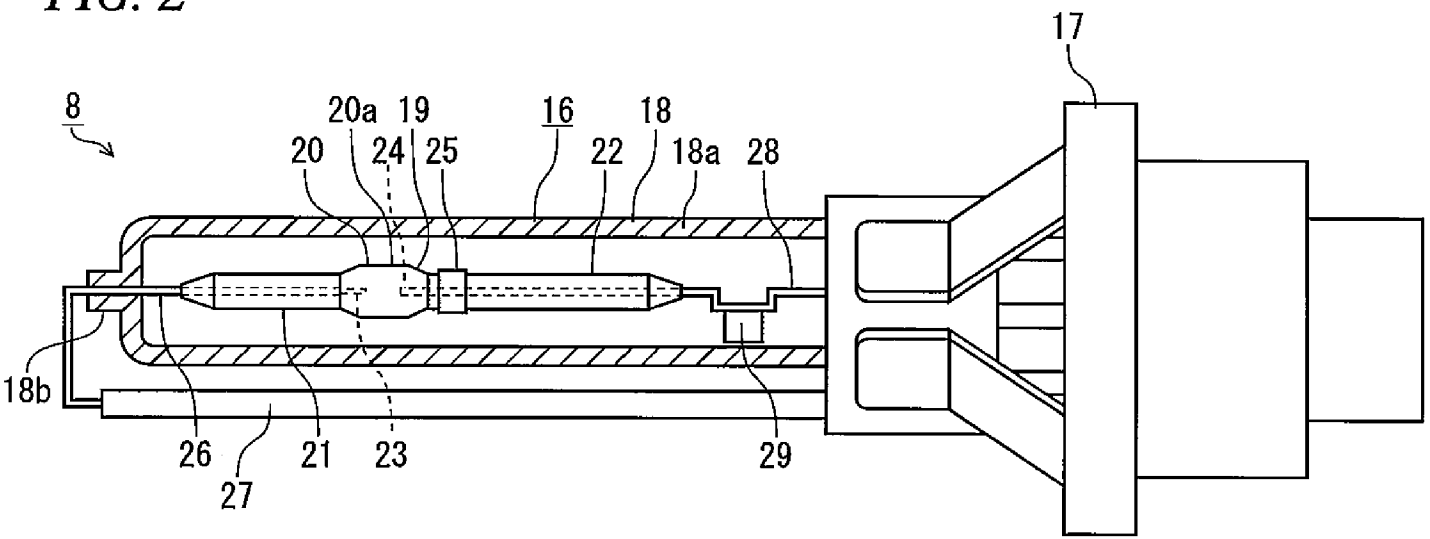
FIG. 2 is an enlarged side view of the discharge lamp of which a part is shown by a cross section.

A main body 16 is connected to a socket 17, so that the discharge lamp 8 is formed (see FIG. 2).

The main body 16 includes an outer tube 18 and a light emitting tube 19 disposed in the outer tube 18.

The outer tube 18 includes a closing portion 18*a* and a holding portion 18*b* that are integral with each other. The closing portion 18*a* covers the light emitting tube 19 and the like, and the holding portion 18*b* protrudes forward from a front end portion of the closing portion 18*a*.

The light emitting tube 19 is made of a ceramic such as alumina, and includes a light emitting portion 20 and fine tube portions 21 and 22 that are connected to both front and rear ends of the light emitting portion 20, respectively. Each of the fine tube portions 21 and 22 is formed substantially in the shape of a cylinder extending in the front-and-rear direction, and the outer diameter of each of the fine tube portions 21 and 22 is smaller than that of the light emitting portion 20.

Iodide and inert gas such as xenon or argon are sealed in the light emitting portion 20 and the end portions of the fine tube portions 21 and 22 close to the light emitting portion 20. A middle portion of the light emitting portion 20 in the front-and-rear direction is formed of a straight portion 20*a* that is formed substantially in the shape of a cylinder extending in the front-and-rear direction (see FIG. 3). The maximum inner diameter of the light emitting portion 20, that is, an inner diameter D of the straight portion 20*a* is set to, for example, 3 mm or less and is preferably set in the range of 1 to 2 mm.

A cathode-side electrode 23 and an anode-side electrode 24, which are formed to extend in the front-and-rear direction, are disposed in the fine tube portions 21 and 22, respectively, so as to be separated from each other in the front-and-rear direction. A rear end portion 23*a* of the cathode-side electrode 23 and a front end portion 24*a* of the anode-side electrode 24 are positioned in the light emitting portion 20.

Meanwhile, an example where the cathode-side electrode 23 is positioned on the front side and the anode-side electrode 24 is positioned on the rear side has been described above, but conversely, the cathode-side electrode 23 may be positioned on the rear side and the anode-side electrode 24 may be positioned on the front side.

The cathode-side electrode 23 is formed in the shape of, for example, a needle having a small diameter and the anode-side electrode 24 is formed in the shape of, for example, a thick rod so that the cross-sectional area of the anode-side electrode 24 is larger than that of the cathode-side electrode 23. Further, tungsten to which thorium oxide is added is an example of material used as the anode-side electrode 24.

A metal film 25 or a metal oxide film 25 is applied or a metal wire 25 is wound on the outer peripheral surface of the fine tube portion 22 that is positioned on the side of the light emitting tube 19 corresponding to an anode.

Figure 3:
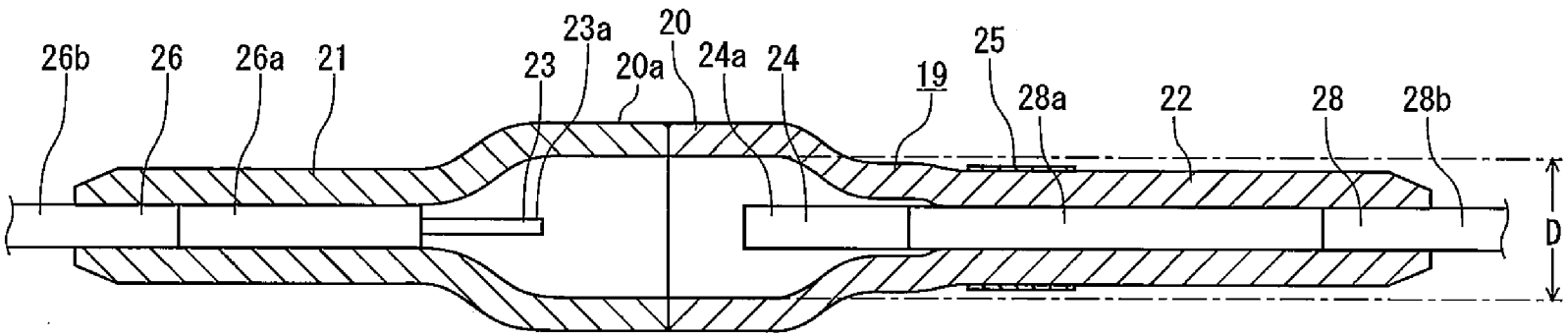
FIG. 3 is an enlarged cross-sectional view showing a part of the discharge lamp.

A first lead wire 26 is connected to the front end of the cathode-side electrode 23 (see FIGS. 2 and 3). The first lead wire 26 includes a portion that protrudes forward from the front fine tube portion 21 of the light emitting tube 19, passes through the holding portion 18*b*, and protrudes toward the outside of the outer tube 18. The portion of the first lead wire 26, which protrudes toward the outside of the outer tube 18, is bent in a predetermined direction, and is connected to a first connection terminal (not shown) of which the rear end portion is provided in the socket 17.

The first lead wire 26 is formed of a first portion 26*a* that is disposed in the fine tube portion 21 and connected to the cathode-side electrode 23, and a second portion 26*b* that is connected to the front end of the first portion 26*a*. The first portion 26*a* is made of, for example, molybdenum, and the second portion 26*b* is made of, for example, niobium. A portion of the second portion 26*b*, which is disposed in the fine tube portion 21, is sealed by frit glass (low melting point glass).

A part of the first lead wire 26 is held by the holding portion 18*b* of the outer tube 18, and an insulating sleeve 27 is coated on a part of the portion of the first lead wire 26 that protrudes toward the outside of the outer tube 18. The insulating sleeve 27 is made of an insulating material, such as glass or ceramic.

A second lead wire 28, which extends substantially in the front-and-rear direction, is connected to the rear end of the anode-side electrode 24. The second lead wire 28 protrudes rearward from the rear fine tube portion 22 of the light emitting tube 19. The rear end portion of the second lead wire 28 is connected to a second connection terminal (not shown) that is provided in the socket 17.

The second lead wire 28 is formed of a first portion 28*a* that is disposed in the fine tube portion 22 and connected to the anode-side electrode 24, and a second portion 28*b* that is connected to the rear end of the first portion 28*a*. The first portion 28*a* is made of, for example, molybdenum, and the second portion 28*b* is made of, for example, niobium. A portion of the second portion 28*b*, which is disposed in the fine tube portion 22, is sealed by frit glass.

A getter 29, which is mounted on the second lead wire 28, is disposed in the outer tube 18. The getter 29 has a function of preventing the deterioration of the luminous efficiency of the discharge lamp 8 by adsorbing impurities (impure gas) that may exist in the outer tube 18.

In the discharge lamp 8, an inert gas such as argon gas or nitrogen gas is sealed as a shroud gas in a space that is formed outside the light emitting tube 19 in the outer tube 18. The pressure of argon gas is set to 0.9 atm or less, and is preferably set to 0.1 atm or less.

A DC lighting system is used as a lighting system in the discharge lamp 8 as described above, and a negative high-voltage pulse is applied to the anode-side electrode 24, so that the discharge lamp 8 starts up. Accordingly, electrons are discharged from the anode-side electrode 24 at the time of the start-up of the discharge lamp 8, and the discharged electrons collide with the cathode-side electrode 23. The anode-side electrode 24 functions as an electron generating member at the time of the start-up of the discharge lamp, and the cathode-side electrode 23 functions as a ground member.

A high-voltage pulse is applied to the anode-side electrode 24 at the time of the start-up of the discharge lamp 8 as described above, and a high-voltage pulse to be applied is negative. Accordingly, after the discharge lamp starts (lights) up, electrons flow to the ground member from the member to which a high-voltage pulse is applied, that is, electrons flow to the cathode-side electrode 23 from the anode-side electrode 24.

If inert gas having negative pressure is sealed in the space that is formed outside the light emitting tube 19 in the outer tube 18 when a high-voltage pulse is applied, dielectric barrier discharge occurs between the second lead wire 28 and the metal film 25, the metal oxide film 25, or the metal wire 25 of the anode-side electrode to which the high-voltage pulse is applied.

When dielectric barrier discharge is caused, the inert gas around the anode-side electrode 24 to which a high-voltage pulse is applied is ionized and electrons are generated. Accordingly, a strong electric field is generated and ultraviolet light is also generated. Main discharge occurs after the dielectric barrier discharge and electrons flow to the cathode-side electrode 23 from the anode-side electrode 24. However, since many electrons are excited around the anode-side electrode 24 by the strong electric field and ultraviolet light generated due to the dielectric barrier discharge, the flow of electrons is rapidly increased with the excited electrons as "seeds".

Since the flow of electrons is increased due to the effect of dielectric barrier discharge as described above, the discharge lamp 8 reliably starts up. Accordingly, it may be possible to reduce the starting voltage. Further, since the starting voltage is reduced, it may be possible to reduce the size of the starting circuit for applying the starting voltage. As a result, it may be possible to reduce manufacturing costs.

Meanwhile, if a high-voltage pulse to be applied is positive, electrons flow to the anode-side electrode 24 from the cathode-side electrode 23. However, since a metal film 25 does not exist near the cathode-side electrode 23, the effect of dielectric barrier discharge is low and most of the electrons do not exist. For this reason, it is difficult to reduce the starting voltage. Moreover, likewise, even when shroud gas is not inert gas or the pressure of shroud gas is high, the effect of dielectric barrier discharge is low. For this reason, it is difficult to reduce a starting voltage.

Further, since the heat transfer coefficient of argon gas is low among the heat transfer coefficients of inert gases, it may be possible to improve the luminous efficiency of the light emitting tube 19 by a heat insulating effect if an argon gas is sealed as a shroud gas in the space that is formed outside the light emitting tube 19 in the outer tube 18.

In the discharge lamp 8, as described above, the cathode-side electrode 23 is formed in the shape of a needle having a small diameter and the anode-side electrode 24 is formed in the shape of a thick rod so that the cross-sectional area of the anode-side electrode 24 is larger than that of the cathode-side electrode 23. Since the anode-side electrode 24 and the cathode-side electrode 23 are formed to have these shapes and sizes, electron decay is apt to occur on the side corresponding to an anode and streamers are easily generated by the concentration of an electric field when a negative high-voltage pulse is applied to the anode-side electrode 24. Accordingly, it may be possible to reduce the starting voltage to be applied to the anode-side electrode 24.

Further, since a negative high-voltage pulse is applied to the anode-side electrode 24 and the cathode-side electrode 23 is formed in the shape of a needle having a small diameter, streamers are easily generated at the end of the cathode-side electrode 23 as described above, so that the end of the cathode-side electrode 23 is heated. For this reason, electrons are easily discharged from the end of the cathode-side electrode 23 and the transition of the discharge lamp from the time of the start-up to the time of stable lighting becomes reliable. As a result, it may also be possible to improve reliability in the transition of the lighting of the discharge lamp.

Furthermore, tungsten to which thorium oxide is added is used as the material of the anode-side electrode 24 in the discharge lamp 8. Thorium oxide is a metal material having a low work function. Accordingly, if thorium oxide is added to tungsten, the work function of the anode-side electrode 24 is lowered. For example, the work function of tungsten is 4.2 eV, but the work function of tungsten is reduced to 2.6 eV if thorium oxide is added to tungsten.

Since thorium oxide having a low work function is added to tungsten as described above, losses caused by the discharge of electrons when a high-voltage pulse is applied to the anode-side electrode 24 at the time of the start-up of the discharge lamp are reduced. Accordingly, the starting voltage is reduced, the temperature rise of the anode-side electrode 24 is suppressed, and the erosion of the anode-side electrode 24 is suppressed. As a result, it may be possible to lengthen the life of the discharge lamp 8 and to improve the luminous efficiency of the discharge lamp.

Further, since tungsten to which thorium oxide is added is used as the material of the anode-side electrode 24, it may be possible to suppress the temperature rise of the anode-side electrode 24 at the time of the start-up of the discharge lamp. Accordingly, it may be possible to reduce the size of the anode-side electrode 24 and to improve the luminous efficiency of the discharge lamp 8.

Since a high-voltage pulse is applied to the anode-side electrode 24 in the discharge lamp 8, the applied high-voltage pulse reaches the cathode-side electrode 23 through the anode-side electrode 24 and the inner surface of the light emitting portion 20. Therefore, as gaps between the inner surface of the light emitting portion 20 and the anode-side electrode 24 and the cathode-side electrode 23 are reduced, it may be possible to reduce the starting voltage.

Accordingly, the inner diameter D of the straight portion 20*a*, which is the maximum inner diameter of the light emitting portion 20, is set to 3 mm or less and is preferably set in the range of 1 to 2 mm in the discharge lamp 8 as described above, so that gaps between the inner surface of the light emitting portion 20 and the anode-side electrode 24 and the cathode-side electrode 23 are reduced. For this reason, a starting voltage is to be reduced.

Further, iodide and an inert gas such as xenon or argon have been sealed in the light emitting portion 20. However, if the inner diameter of the light emitting portion 20 is reduced, the temperature of the light emitting portion 20 rises at the time of the start-up of the discharge lamp. For this reason, more iodide is easily deposited on the fine tube portions 21 and 22 as compared to the light emitting portion 20. Accordingly, the area, which is occupied by a ceramic such as alumina of which the dielectric constant is higher than the dielectric constant of iodide, is increased in the light emitting portion 20, so that a starting voltage is reduced.

As described above, in the discharge lamp 8, inert gas having negative pressure has been filled in the space that is formed outside the light emitting tube 19 in the outer tube 18, a metal film 25 or a metal oxide film 25 has been applied or a metal wire 25 is wound on the outer peripheral surface of the fine tube portion 22 that is positioned on the side of the light emitting tube 19 corresponding to an anode, and a negative high-voltage pulse has been applied to the anode-side electrode 24 at the time of the start-up of the discharge lamp.

Accordingly, it may be possible to reduce the starting voltage at the time of the start-up of the discharge lamp, and to improve the reliability of the start-up of the discharge lamp and to reduce manufacturing costs of the discharge lamp by the reduction of the starting voltage.

All the shapes and structures of the respective components described in the exemplary embodiment of the invention are merely illustrative of an exemplary embodiment of the invention, and the scope of the invention should not be interpreted restrictively by the shapes and structures of the respective components.

What is claimed is:

1. A vehicular discharge lamp that emits light by a DC lighting system, the vehicular discharge lamp comprising:

an outer tube that is mounted on a socket;

a light emitting tube that is disposed in the outer tube, and that includes a light emitting portion and a pair of fine tube portions connected to the light emitting portion on the opposite sides of the light emitting portion;

a cathode-side electrode and an anode-side electrode that are disposed in the light emitting tube;

two lead wires which are respectively connected to the cathode-side electrode and the anode-side electrode, wherein at least a part of each of the two lead wires is disposed in the outer tube; and one of a coated layer or a metal wire, wherein the coated layer is one of a metal film or a metal oxide, wherein the coated layer is applied only on an outer peripheral surface of the fine tube portion that is positioned on an anode side of the light emitting tube among the pair of tube portions, wherein the metal wire is wound only on the outer peripheral surface of the fine tube portions that is positioned on the anode side of the light emitting tube among the pair of fine tube portions, and wherein inert gas having negative pressure is filled in a space outside the light emitting tube in the outer tube.

2. The vehicular discharge lamp according to claim 1, wherein tungsten to which thorium oxide is added is used as a material to form the anode-side electrode.

3. The vehicular discharge lamp according to claim 1, wherein the maximum inner diameter of the light emitting portion is set to 3 mm or less in a direction perpendicular to a direction where the pair of fine tube portions are connected to each other.

4. The vehicular discharge lamp according to claim 1, further comprising:

a starting device which applies a negative high-voltage pulse to the anode-side electrode at a time of start-up.

5. The vehicular discharge lamp according to claim 1, wherein the anode side electrode is an electron generating member, and the cathode-side electrode is a ground member.

6. The vehicular discharge lamp according to claim 1, wherein the lamp comprises the coated layer including the metal oxide.

7. The vehicular discharge lamp according to claim 1, wherein the lamp comprises the metal wire.

8. The vehicular discharge lamp according to claim 1, wherein a getter that is mounted on one of the two lead wires and absorbs impurities in the outer tube.

9. The vehicular discharge lamp according to claim 1, wherein a pressure of the inert gas is 0.9 atm or less.

10. The vehicular discharge lamp according to claim 9, wherein a pressure of the inert gas is 0.1 atm or less.

* * * * *